United States Patent [19]

Maury

[11] Patent Number: 5,040,465

[45] Date of Patent: Aug. 20, 1991

[54] LAUNCHING PROJECTILE FOR ELECTROMAGNETIC DECOYS

[76] Inventor: Louis Maury, 31, rue de l'Aubépine, 31 Toulouse, France

[21] Appl. No.: 859,667

[22] Filed: Dec. 7, 1977

[30] Foreign Application Priority Data

Dec. 10, 1976 [FR] France ..... 76 37263

[51] Int. Cl.[5] ..... F42B 12/70

[52] U.S. Cl. ..... 102/505; 102/357; 102/489

[58] Field of Search ..... 102/7.2, 34.4, 35.6, 102/37.6, 63, 69, 89 CD, 93, 340, 341, 351, 357, 489, 505

[56] References Cited

U.S. PATENT DOCUMENTS

| | | | |
|---|---|---|---|
| 3,023,703 | 3/1962 | Beatty | 102/89 CD |
| 3,620,167 | 11/1971 | Romer et al. | 102/93 |
| 3,750,575 | 8/1973 | Heede et al. | 102/69 |
| 3,765,336 | 10/1973 | Kulsik | 102/89 CD |
| 3,802,345 | 4/1974 | Costa | 102/93 |
| 3,837,278 | 9/1974 | Gustafsson | 102/89 CD |

FOREIGN PATENT DOCUMENTS

| | | | |
|---|---|---|---|
| 2343990 | 10/1977 | France | 102/89 CD |

*Primary Examiner*—Deborah L. Kyle
*Assistant Examiner*—Stephen Johnson
*Attorney, Agent, or Firm*—Cushman, Darby & Cushman

[57] ABSTRACT

The invention relates to a projectile for launching and dispersing electromagnetic decoys. The projectile essentially comprises a sleeve which co-operates with a sleeve cap to form a case open at one end. The sleeve contains a decoy carrying piston and is detachably closed by a closure member. The decoy carrying piston comprises shells in the form of cylindrical sectors which keep the decoys arranged in a multi-cell cylinder as long as the piston head is not outside the sleeve. Special shaping of the shells and radical springs produce simultaneous dispersion of all the shells when the projectile operates.

7 Claims, 2 Drawing Sheets

LAUNCHING PROJECTILE FOR ELECTROMAGNETIC DECOYS

FIELD OF THE INVENTION

The invention relates to a projectile for launching and dispersing electromagnetic decoys in a given region in space.

PRIOR ART

Certain types of projectiles have already been proposed for the purpose of protecting a vehicle such as a ship from a missile or similar offensive device equipped with an electromagnetic guidance system. In one of these types of projectiles, a case open at one end encloses a payload of electromagnetic decoys and a pyrotechnical charge is arranged at the closed end of the case for the purpose of expelling the decoy payload enclosed therein. In another known type of projectile for launching electromagnetic decoys, the decoys are arranged around an explosion axis comprising a tube provided with apertures and containing a plurality of expulsion charges.

The first known type of projectile can only produce an elongated cloud running along the trajectory. The second known projectile type, also, is unable to disperse the decoys sufficiently widely in space when the decoy payload is expelled.

SUMMARY OF THE INVENTION

An object of the invention is to overcome these disadvantages by providing a decoy launching projectile capable of producing instantaneous and simultaneous dispersal of all the decoys in a given region in space in which the decoys must form a cloud of a certain density.

More particularly, a decoy launching projectile embodying the invention is of the type in which a sleeve open at one end encloses a payload of electromagnetic decoys and a pyrotechnical charge situated at the closed end of the sleeve, for the purpose of expelling the payload of decoys enclosed therein. This payload is distributed in a plurality of distinct troughs arranged around a central passage. The invention is characterized in that the troughs comprise shells forming cylindrical sectors which are connected by a closure member at their ends remote from the expulsion charge and which rest on a support plate by means of their other ends.

The support plate is provided with radial bores which contain springs capable of separating the shells when they come out of the sleeve. Those surfaces of the shells directed towards the expulsion charge contain recesses which can create turbulence in an axial air flow tending to move the shells away from the axis of the projectile. Lastly, the shells are completed by cylindrical outer walls so that the payload is not dispersed until the entire payload has come out of the sleeve.

Advantageously, the connected shells form a passage which can act as a firing channel between an ignition device associated with the support plate and a pyrotechnical device situated in the closure member. To permit correct operation of a projectile embodying the invention, the closure member is detachably associated with the open end of the sleeve.

In one embodiment of the invention, the closure member must, for example, be associated with the body of a rocket, of which the projectile therefore constitutes the head.

The invention also consists of a weapon for launching and dispersing a large number of electromagnetic decoys in a region in space, comprising in an envelope a launching projectile as defined above and a pyrotechnical charge arranged in the base of the envelope for ejection of the projectile.

BRIEF DESCRIPTION OF THE DRAWINGS

The invention will be better understood from the ensuing description referring to the accompanying drawings, which are given by way of example and in which.

DETAILED DESCRIPTION

Figure 1:
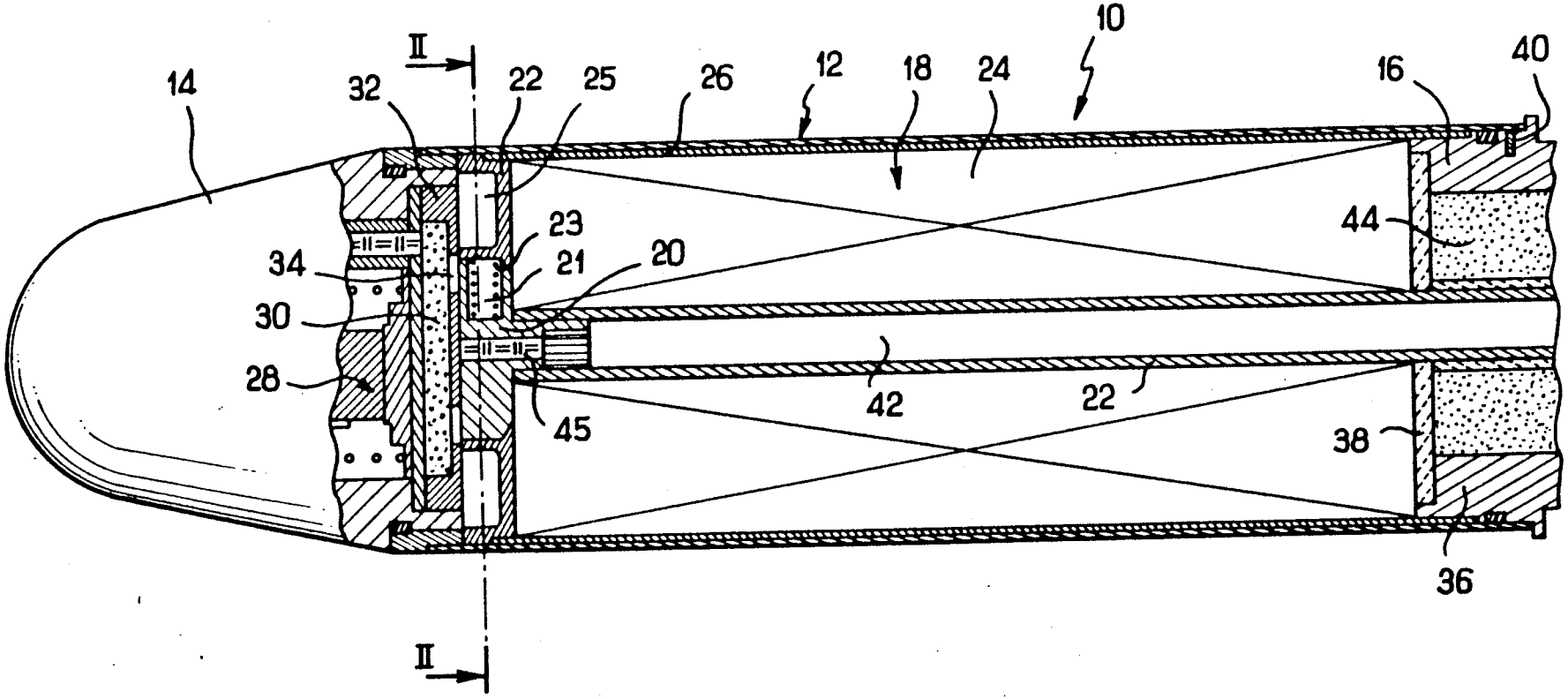
FIG. 1 is a partial axial section taken along line I—I in FIG. 2 of a weapon for launching electromagnetic decoys embodying the invention.
Figure 2:
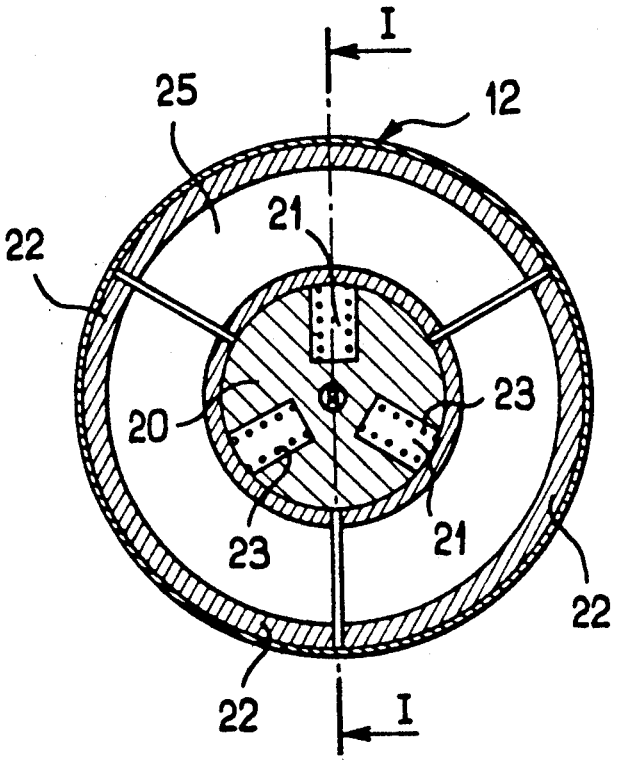
FIG. 2 is a sectional-view taken along line II—II in FIG. 1.

FIG. 1 illustrates a weapon 10 for launching and dispersing in a given region in space a large number of electromagnetic decoys, more commonly known as "chaff". The shape of the weapon 10 depends on the launching device for which it is intended.

A weapon 10 embodying the invention essentially comprises a sleeve 12, a sleeve cap 14, a closure member 16 and a decoy carrying piston 18. The sleeve 12 and sleeve cap 14 form a case which is open at one end and which is to receive the decoy carrying piston 18 and then be closed by the closure member 16.

The decoy carrying piston 18 has a head or support plate 20. The support plate contains radial bores 21 for springs 23. The decoy carrying piston 18 also comprises shells 22 in the form of cylindrical sectors containing recesses 25 facing forwards in the assembly mounted on the projectile. The piston then, of course, contains the decoys, designated 24. Cylindrical walls 26 can make up the outer surfaces of the shells 22.

The sleeve cap 14 comprises, in particular, a conventional system 28 for arming and for time delay on arming. It also comprises a pyrotechnical chain for dispersing the electromagnetic decoys, this chain ending in a trough expulsion charge 30. A disc 32 is attached to the sleeve cap 14 in a cross-sectional plane of the sleeve 12 at the junction between the cap and the sleeve itself. The disc 32 contains apertures 34 to permit axial propagation, along the axis of the projectile, of the effect of the expulsion charge 30, which is pressed onto the disc 32.

Lastly, the closure member 16 essentially comprises a body 36 and a partition 38 separating the contents of the sleeve 12 from its own constituent parts. The connection between the closure member 16 and the sleeve 12 must be such that the closure member can be detached from the sleeve 12 to expose the open end of the case formed by the sleeve. A suitable means of obtaining this result is to connect the closure member 16 and the sleeve 12 by means of pins 40 which can be sheared off.

The decoy launching projectile is itself launched by a motor capable of receiving the body 36. In one embodiment, the body 36 may be attached, for example, by a screw threaded connection, to the body of a rocket, of which the projectile will therefore from the head. In another embodiment, all the projectiles may be contained in an envelope which, for example, comprises in its base a pyrotechnical charge which ejects the projectile from a tube.

After a delay following launching (the delay being determined by the time delay system 28), the pyrotechnical ignition chain can fire the expulsion charge 30. Gases arising from combustion of this expulsion charge 30 can pass through bores 34 and act on the decoy carrying piston 18 in an axial direction, urging the piston out of the sleeve 12 after the pins 40 have been sheared off.

While the decoy carrying piston 18 is moving out of the sleeve 12, the cylindrical walls 26 are held on by the flow of air around the projectile and help to keep the troughs of decoys arranged in a cylindrical envelope.

When the piston head 20 comes level with the trailing end of the sleeve 12, the front ends of the shells or troughs 22 are still engaged in the sleeve, and the decoys are still grouped inside a multi-cell cylinder formed by the combination of shells 22.

As soon as the head 20 of the piston 18 is out of the sleeve 12, the radial springs 23 act on the front ends of the shells 22, moving the latter away from the axis of the projectile. The air flow resulting from the speed of the projectile as it moves through the dense layers near the ground or the surface of the sea will now tend to engage the recesses 25 in the front end faces of the shells 22. Under the influence of the dynamic pressure and of the turbulence created, the shells 22 can move well away from the projectile axis, and the decoys 24 can be dispersed simultaneously, instantaneously and in a concentrated manner in space. The object of the invention is therefore fulfilled namely, the immediate production of a concentrated, high-density cloud of electromagnetic decoys at a given location in space.

In the embodiment illustrated, a tracer charge 44 may, for example, be provided in the closure member 16. It may be fired by way of an axial firing channel 42 formed by the cylindrical shells 22. The partition 38 protects the decoys 24 from the heat evolved during combusion of the tracer charge 44. The firing of the tracer charge 44 is effected via relay charge 45 in support plate 20 and the combustion gases pass through channel 42 and gaps between shells 22 to fire the tracer charge 44.

Each of the shells 22 may be formed by a section of light material such as aluminum. In the embodiment illustrated, the shells 22 are three in number, but it will be appreciated that any number could be provided.

Obviously, the invention is not restricted to the embodiments described and illustrated, and numerous modifications, especially as regards the shape of the weapon 10, the constituents of the sleeve cap 14, the number and shape of the shells 22 and of the packages of decoys which they contain, the length and cross-sectional shape of the sleeve 12, and the structure and operation of the closure member 16, are possible within the scope of this invention.

I claim:

1. A projectile for launching electromagnetic decoys comprising a sleeve having an open end and a closed end, said sleeve enclosing a payload of electromagnetic decoys, a pyrotechnical charge situated at the closed end of the sleeve for expelling the payload of decoys enclosed in the sleeve, the payload being distributed in a plurality of distinct troughs arranged around a central passage, said troughs comprising shells forming cylindrical sectors having opposite ends, a closure member connecting said sectors at their ends remote from the expulsion charge and a support plate supporting said shells at their other ends, said support plate being provided with radial bores and spring means in said bores for separating the shells when they come out of the sleeve.

2. A projectile as claimed in claim 1, wherein those end faces of the shells directed towards the expulsion charge contain recesses which can create turbulence in an axial air flow tending to move the shells away from the axis of the projectile.

3. A projectile as claimed in claim 1 wherein said shells are completed by cylindrical outer walls so that the payload is not dispersed until the entire payload has come out of the sleeve.

4. A projectile as claimed in claim 1 wherein said shells form a passage which can act as a firing channel between an ignition device associated with the support plate and a pyrotechnical device situated in the closure member.

5. A projectile as claimed in claim 1 comprising means detachably connecting the closure member with the open end of the sleeve.

6. A projectile as claimed in claim wherein the closure member is associated with the body of a rocket, of which the projectile therefore constitutes the head.

7. A weapon for launching and dispersing a large number of electromagnetic decoys in a region in space, which comprises in an envelope a launching projectile as claimed in claim 1 and a pyrotechnical charge arranged in the base of the envelope for ejection of the projectile.

* * * * *